United States Patent [19]

McCranie et al.

[11] 4,345,413

[45] Aug. 24, 1982

[54] BOX LIDDING SYSTEM AND APPARATUS

[75] Inventors: Stephen C. McCranie, Woodstock, Ga.; Andrew J. Houseman, Jacksonville, Fla.

[73] Assignee: Sav-A-Stop Incorporated, Jacksonville, Fla.

[21] Appl. No.: 81,790

[22] Filed: Oct. 4, 1979

[51] Int. Cl.[3] ..... B65B 7/28

[52] U.S. Cl. ..... 53/315; 271/3.1

[58] Field of Search ..... 53/314, 313, 315, 201, 53/202, 316; 271/3.1; 221/11, 297, 298; 29/3.1, 218, 192

[56] References Cited

U.S. PATENT DOCUMENTS

| | | | |
|---|---|---|---|
| 1,866,369 | 7/1932 | Podel | 53/313 X |
| 2,074,815 | 3/1937 | Tevander et al. | 53/315 X |
| 2,188,759 | 1/1940 | Redd | 53/313 X |
| 2,304,437 | 12/1942 | Bell | 53/315 X |
| 2,341,126 | 2/1944 | Stover | 53/313 X |
| 2,352,764 | 7/1944 | Bell | 53/313 X |
| 2,355,479 | 8/1944 | Stover | 53/313 X |
| 2,669,377 | 2/1954 | Van Poolen et al. | 53/314 X |
| 3,408,789 | 11/1968 | Reddick | 53/315 |
| 3,601,282 | 8/1971 | Vogel | 221/298 X |
| 3,906,703 | 9/1975 | Heisler | 53/333 X |
| 3,924,384 | 12/1975 | Kinney | 53/314 X |
| 3,938,697 | 2/1976 | Kinney | 53/313 X |
| 4,046,370 | 9/1977 | Navi | 271/3.1 |

FOREIGN PATENT DOCUMENTS

| | | | |
|---|---|---|---|
| 727764 | 4/1955 | United Kingdom | 53/313 |

*Primary Examiner*—Horace M. Culver
*Attorney, Agent, or Firm*—Arthur G. Yeager

[57] ABSTRACT

A continuous system and apparatus for applying a rectangular lid with depending flanges to a rectangular box by continuously passing a series of spaced open top boxes through a lidding station beneath a stack of lids directly above the lidding station, dropping the bottom lid from the stack into position to be picked up by the box as it passes through the lidding station.

16 Claims, 4 Drawing Figures

BOX LIDDING SYSTEM AND APPARATUS

BACKGROUND OF THE INVENTION

Many manufactured commodities are transported or sold in boxes or other containers which have a removable lid. In order to avoid the necessity of having a human labor force fill the boxes and apply lids thereto there have been many developments of apparatus and systems which will perform the operations mechanically without the help of humans. In some instances the goods as sold to the consumer are packaged in such a box in other instances many individual units are packaged together in a carton for transportation from the manufacturer to the distributor and on to the retailer. In more recent times there have been developments in which reusable cartons are employed to transfer goods from the manufacturer to the distributor and on to the retainer, and thereby eliminating the waste involved in employing a cardboard carton which is used one time only. These more modern cartons are frequently called "tote boxes" and are made of plastic materials which are light in weight and yet strong enough to carry substantial loads. These tote boxes can be used in a few standard sizes (e.g. 1–3 ft. wide×2–4 ft. long×0.5–1.5 ft. deep) to carry any of hundreds or thousands of varieties of products from the manufacturer or distributor to the retailer or from a large inventory of items which are stored temporarily by the retailer and carried in tote boxes from the storage supply to the shelves of the retailer's store for ultimate sale to the consumer. In normal use the tote box is fitted with a lid after the box is filled with the necessary items so that filled boxes can be stacked on top of each other for storage or transportation.

In the prior art there have been many developments wherein a series of open top bottles is passed continuously through a station where caps are applied. Similarly there are systems to apply lids to small (5–10 oz.) plastic tubs such as those used for oleomargarine, cottage cheese, etc. These containers and lids are relatively small and easy to handle. In contrast, the tote boxes, to which this invention is particularly directed, are large in volume and weight, and they present entirely different handling problems than the small bottles and tubs mentioned above.

It is an object of this invention to provide a system for continuously applying lids to open top tote boxes moving continuously through a lidding station.

It is another object of this invention to position and to press into place a rectangular lid with depending flanges to a rectangular open top box while being transported on a continuously moving conveyor.

Still other objects will become apparent from the more detailed description of this invention which follows.

BRIEF SUMMARY OF THE DESCRIPTION

This invention provides a continuous system for placing a removable rectangular lid with depending flanges on an open top rectangular box comprising:

(a) means for continuously passing a series of spaced open top boxes through a lidding station in a preselected orientation to receive a lid;

(b) a plurality of lids suspended in a stack above the lidding station; and (c) means for selectively separating the bottom lid from said plurality of lids and dropping the bottom lid into a position to be picked up by the leading edge of a box moving through the lidding station (d) In specific embodiments of this invention there are employed pairs of retractable fingers on opposite sides of said stack to support and to release the stack of lids; there are pairs of retractable tongues to separate the bottom lid from the next-to-the-bottom lid; there are three separate stacks of lids, one of which is positioned to drop lids onto boxes in the lidding station, and the other two are positioned to replenish the first stack; there are means to catch the bottom lid dropped from the stack of lids and to hold it in position to be placed on a box passing through the lidding station; and there are pressure means to press the lid into place as it leaves the lidding station.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION

Figure 1:
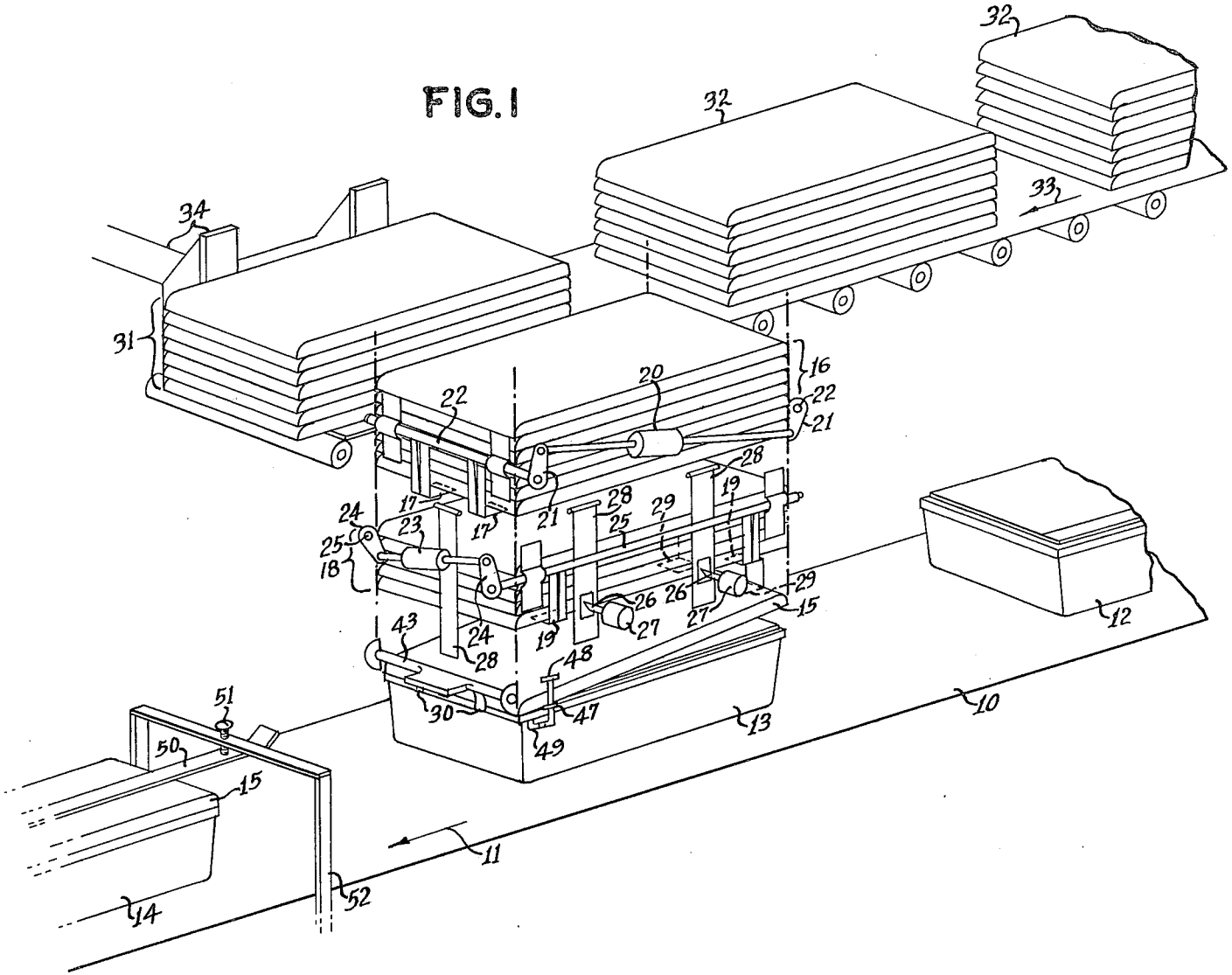
FIG. 1 is an overall perspective view of the system and apparatus of this invention.

In FIG. 1 there is shown an overall view of the general system and apparatus of this invention. A conveyor 10 continuously moving in the direction of arrow 11 brings an open box 12 to lidding station 13 where a lid 15 is applied and removes lidded box 14 for transportation elsewhere. Directly above box 13 at the lidding station is a first stack of lids 18 supported by two opposed pairs of spaced retractable members or fingers 19, one pair being shown here and it being understood that there is another pair of fingers 19 on the opposite side of stack 18 to provide support by two pair of such fingers. Each pair of retractable fingers 19 is fixed to a shaft 25 such that any rotation of the shaft 25 will simultaneously cause fingers 19 to pivot. Crank arms 24 are fixed to the ends of shafts so as to rotate when shafts 25 rotate. The opposite end of each crank arm 24 is attached to a source of power capable of causing crank arms 24 and shafts 25 to rotate. In this drawing the power source is a double-acting fluid preferably pneumatic, cylinder with piston and associated piston rod. Crank arms 24 and the respective piston rods of cylinder 23 are so arranged that movement of the piston in one direction will cause both shafts 25 to rotate and all four retractable fingers 19 to move away from supporting stack 18. Similarly, movement of the piston in cylinder 23 in the opposite direction causes all four retractable fingers 19 to move back to the position shown in the drawing.

Vertically above first stack 18 is second stack 16 of lids functioning as a reserve stack to be dropped onto fingers 19 after first stack 18 has been depleted to a predetermined number of lids, e.g. 1–5, as will described hereinafter. Stack 16 is also supported by two pairs of retractable members or fingers 17 attached to shafts 22 which are turned through crankarms 21 by movement of the piston in cylinder 20 exactly in the same manner described with respect to stack 18. A third stack of lids is shown in stack 31 which is moved to replace stack 16 after it has been dropped onto fingers 19 to replace stack 18. There is nothing critical as to how stack 31 may be moved to replace stack 16 nor as to how stack 31 is itself replaced, since any of a variety of equipment can be employed for this purpose. In this drawing there is shown a conveyor with a series of stacks of lids 32 moving in the direction of arrows 33. When needed, stack 31 is moved by a fork lift means 34, appropriately powered by a means not shown here, so as to place stack 31 onto retractable fingers 17 and thereby to replace stack 16.

Operating in conjunction with the first stack 18 is a multiplicity of elongated guides 28 for precisely positioning lids in the lidding station to be released from stack 18 and applied to an open top box passing therebelow. The releasing mechanism involves two opposed pairs of retractable members or tongues 26 which are positioned to be inserted between the bottom and the next-to-the-bottom lid in stack 18 to support stack 18 while the retraction of fingers 19 permits the bottom lid to drop into position to be picked up by box 13 as it passes through the lidding station. Any power source is suitable for operating tongues 26, and that which is shown here involves a fluid powered cylinder 27 preferably pneumatic. A pair of spaced retractable tongues 26 are shown in this illustration and it is to be understood that the apparatus would employ a corresponding pair (not shown) on the opposite side of stack 18 in order to provide a four point support for the lids in stack 18.

When the bottom lid of stack 18 is released its rearward edge is caught by fixed supporting shoulders 29 and the forward edge is caught by two laterally deflectable fingers 47 which are supported by hinge 28 which includes a spring to bias fingers 47 inwardly, i.e. toward box 13. Extending forwardly and below finger 47 is probe 49 which is so fashioned that it will deflect laterally by the forward movement of box 13 and will cause finger 47 to be withdrawn from providing any support to lid 15, the depending flange of lid 15 on its forward edge is caught by the forward edge of box 13 at the same time that probe 49 contacts the leading portion of box 13. Forward movement of box 13 pulls lid 15 off supporting shoulders 29 permitting the trailing or rearward edge of lid 15 to fall onto box 13. Swinging guide members 30 when in the position shown in the drawing serve to prevent lid 15 from sliding forward before the lid is caught by box 13 in its forward movement. As box 13 with lid 15 in place continues to move forward guide members 30 rotate about shaft 43 as a pivot and guide members 30 provide downward pressure on the top of lid 15 helping to press it into place. A short distance farther box 14 and lid 15 are subjected to another pressure means to assure that lid 15 is firmly attached to box 14. The device shown here is a horizontal bar 50 oriented generally along the longitudinal center line of box 14 and lid 15 and adjusted by screw means 51 attached to frame 52 to provide pressure to push lid 15 downwardly onto box 14. Other convenient means can be used to accomplish the same purpose, e.g. rollers bearing upon the top of lid 15, reciprocating feet to alternately press lid 15 and then to release the pressure, etc.

Figure 2:
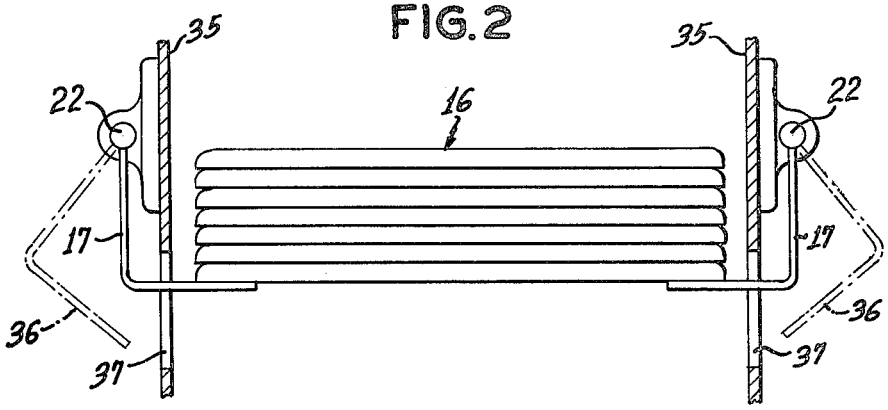
FIG. 2 is a schematic illustration of the use and operation of retractable fingers in holding the upper stack of lids in this invention.

In FIG. 2 there is an illustration of the general operation of fingers 17 in supporting and releasing second stack 16 of lids. Stack 16 is a reserve supply which is dropped vertically to be caught by lower retractable fingers 19 when first stack 18 has been exhausted reduced to a predetermined size, e.g. containing 1–5 lids. Stack 16 is placed inside magazine housing 35 by any suitable means such as those described above with respect to fork lift means 34. In their normal supporting position retractable fingers 17 are in the solid line position and when it is time to drop stack 16 to the lower position, shafts 22 are rotated so as to retract fingers 17 to the broken line position shown at 36. It is of course necessary that a suitable passageway 37 be provided in housing 35 to permit fingers 17 to move from one position to another.

Figure 3:
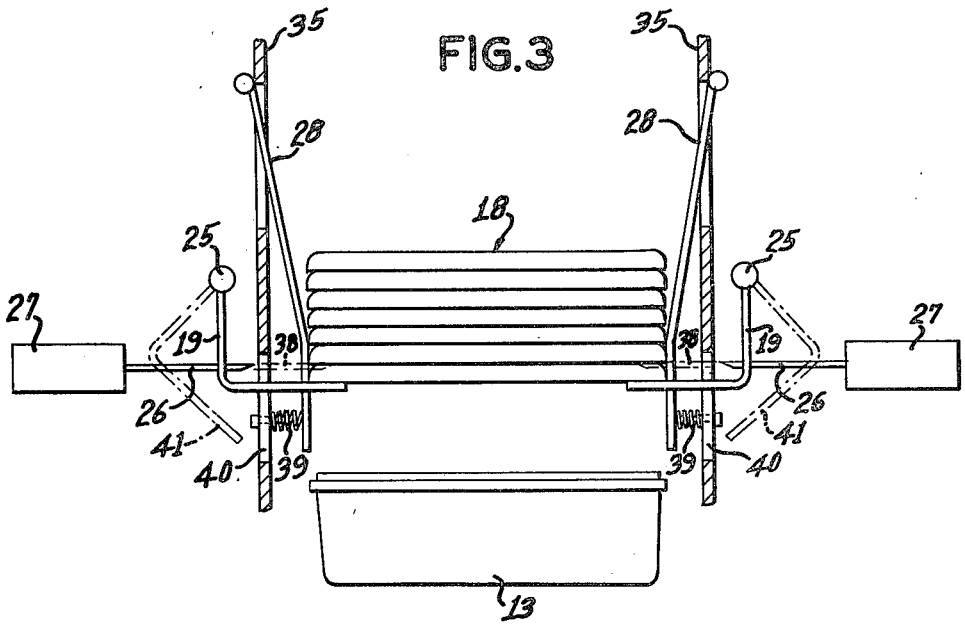
FIG. 3 is a schematic illustration of the holding and release of lids in the lower stack of lids in this invention.

In FIG. 3 there is a schematic illustration of the means by which the lids are dropped onto box 13 in the lidding station. Magazine housing 35 supports a set of retractable fingers 19 operating through passageways 40 in housing 35. When fingers 19 are to be retracted to position 41 it is only necessary to rotate shafts 25 in the appropriate direction. In order to permit the bottom lid of stack 18 to be separated from the stack two pair of spaced retractable tongues 26 on opposite sides of the stack are inserted to their broken line position 38 between the bottom lid and the next-to-the-bottom lid in stack 18. Tongues 26 have sharpened leading edges to insure appropriate separation between the adjacent lids and are sufficiently strong to support stack 18 when fingers 19 are retracted to permit the bottom lid to drop onto open box 13. Guide members 28 are provided to vertically align and position each lid when it reaches the bottom of stack 18 to a precisely predetermined position above box 13 as it passes through the lidding station. Guides 28 may be adjusted by any suitable means but preferably are biased against the edges of lids in stack 18 by appropriate springs 39.

Figure 4:
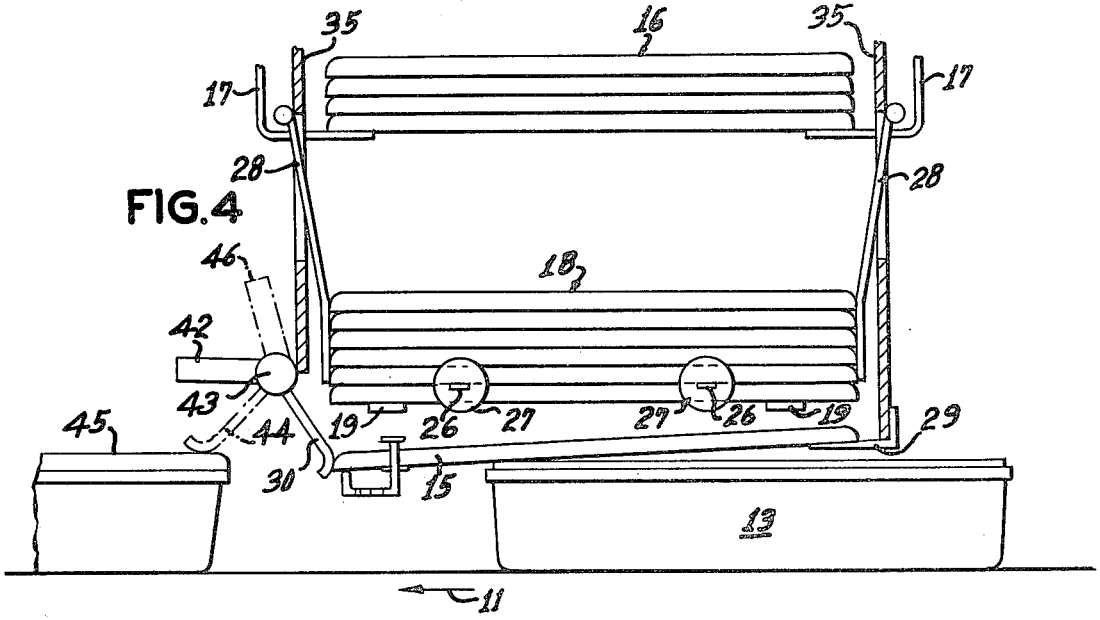
FIG. 4 is a schematic illustration of the system and apparatus of this invention employed in positioning an open box and applying a lid to the top of that box.

In FIG. 4 there is illustrated the final operation in applying lid 15 to box 13 when in the lidding station. Suspended above box 13 and lid 15 is reserve stack 16 inside of magazine housing 35 supported by retractable fingers 17. First stack 18 is held in position by retractable fingers 19 with the lids guided to a precise position by guide members 28. Retractable tongues 26 are shown in the position to separate the bottom lid from the next-to-the-bottom lid in the stack 18. When bottom lid 15 falls from stack 18 by reason of the insertion of tongues 26 into stack 18 and the retraction of fingers 19 away from stack 18, the rear edge of lid 15 is caught by a fixed supporting shoulder members 29 while the front edge of lid 15 falls onto laterally deflectable supporting fingers 47 and rests against swinging guide members 30 attached to rotatable shaft 43. Guide members 30 are held against leading edge of box 13 by the action of counterbalance 42. As box 13 moves forward its uppermost portions catch depending flanges on lid 15 and pull lid 15 forward along with the movement of box 13 in the direction of arrow 11. Swinging guide member 30 rotates about box 45 to pass.

It is frequently desirable to include a pressure means subsequent to the lidding operation, and this may be used in place of, or in addition to, swinging guide members 30, shaft 43, and counterbalance 42. A useful pressure means for this purpose was described in connection with FIG. 1 wherein a horizontal bar member is adjustably supported over the centerline of lidded box 45 and applies sufficient pressure, to push lid 15 down onto box 13 and yet not interfere with the movement of lidded boxes on the conveyor system. In many instances it is desirable to pass the lidded boxes through a banding station where a tight band is placed around the box and lid to prevent the lid from accidentally being removed.

While the invention has been described with respect to certain specific embodiments it will be appreciated that many modifications and changes may be made by those skilled in the art without departing from the spirit of the invention. It is, intended, therefore, by the appended claims to cover all such modifications and changes as fall within the true spirit and scope of the invention.

What is claimed as new and what is desired to secure by Letters Patent of the United States is:

1. In a continuous system for placing a plurality of removable rectangular lids with depending flanges respectively on open top rectangular boxes comprising:

(a) a continuously moving generally horizontal conveyor adapted to move said open top boxes through a lidding station in a preselected orientation to receive respective said lids;

(b) a vertical chute positioned above said conveyor at said lidding station for maintaining a stack of lids in horizontal orientation corresponding to said open top boxes;

(c) at least four spaced movable fingers attached to said chute with two said fingers supporting each of opposed sides of said stack of said lids when inserted below the bottom lid in said stack, means to connect all of said fingers together for simultaneous retraction to a position providing no support for said stack;

(d) at least four spaced movable tongues attached to said chute above said fingers with two of said tongues insertable on each of opposed sides between the bottom lid and the next-to-the-bottom lid in said stack to support opposed sides of said lids resting on and above said tongues, means to connect all of said tongues together for simultaneous retraction to a position providing no support for said stack;

(e) pneumatic power means to selectively move said tongues simultaneously to their inserted position; and (f) pneumatic power means to selectively move said fingers simultaneously into their retracted position after said tongues are in their inserted position to release said bottom lid onto an open top box in said lidding station.

2. In the system of claim 1 wherein said vertical chute includes selective means below said fingers to catch and release said bottom lid which is dropped from said stack of lids prior to contact with an open top box.

3. In the system of claim 1 wherein said means to catch said bottom lid comprises a fixed rearward supporting shoulder means for supporting the rearward end portion of said bottom lid and a deflectable forward supporting shoulder means for releasably supporting the forward portion of said bottom lid.

4. In the system of claim 3 wherein said forward supporting shoulder means is deflected by said open box passing therebelow causing the forward edge of said forward portion to be engaged by the forward edge of the open box passing therebelow and pulls said lid forward with continued movement of said box causing the rearward edge of said bottom lid to fall off said rearward shoulder means onto said box.

5. In the system of claim 3 wherein said deflectable forward supporting shoulder means comprises a pair of laterally spaced fingers which are laterally deflectable by the sides of an open box passing therebetween from a position supporting said lid to a position providing no support for said lid.

6. In the system of claim 1 wherein said vertical chute includes guide members biased inwardly toward the center of said chute and operatively contacting all four sides of said stack of lids to precisely position said bottom lid directly above said open top box.

7. In a continuous system for placing a plurality of rectangular lids each with depending flanges onto respective open top rectangular boxes in series passing continuously through a lidding station comprising:

(a) a continuously moving generally horizontal conveyor supporting said open top boxes each of which is oriented in the same preselected position and for moving said boxes through said lidding station;

(b) a vertical chute located vertically above said lidding station and adapted to contain a plurality of stacks of said lids in horizontal orientation corresponding to that of said boxes and in close proximity thereto;

(c) at least four spaced movable fingers attached to the lower portion of said chute with two said fingers supporting each of opposed sides of a lower said stack of said lids, means to connect all said fingers together for simultaneous movement thereof, selective pneumatic power means to move said fingers simultaneously from a position inwardly of said chute and supportive of said lower stack to a position nonsupportive of said lower stack;

(d) at least four spaced movable tongues attached to said chute in close proximity to and vertically above said fingers with two said tongues supporting each of opposed sides of said lower stack above the bottom one of said lids, means to connect all said tongues together for simultaneous movement thereof, selective pneumatic power means to simultaneously move said tongues from a position inwardly of said chute and supportive of said lower stack of said lids above said bottom lid to a position nonsupportive thereof;

(e) at least four spaced support members movably attached to the upper portion of said chute with two said members supporting each of opposed sides of an upper stack of said lids, means to connect all said members together for simultaneous movement thereof, selective pneumatic power means to move said members simultaneously from a position inwardly of said chute and supportive of said upper stack to a position nonsupportive thereof whereby said upper stack of lids falls onto the topmost lid of said lower stack of lids; and (f) means responsive to movement of said open top boxes by said conveyor to actuate said power means associated with said tongues and thereafter to actuate said power means associated with said fingers to release said bottom lid of said lower stack to fall upon an open top box in said lidding station.

8. In the system of claim 7 further comprising a pair of laterally deflectable fingers and shoulder means below said four fingers for catching and releasably supporting said bottom lid when released to fall freely from said lower stack of lids after support of said lids thereabove is made by said tongues.

9. In the system of claim 8 wherein said pair of laterally deflectable fingers are positioned to support the forward edge of said bottom lid at a lower elevation than the rearward edge of said lid supported by said shoulder means, said lower elevation being below the upper edge of an open top box whereby said open top box passing through said lidding station will contact said forward edge and pull said lid off said supporting shoulder means thereby permitting the rearward edge of said lid to fall upon said box.

10. In the system of claim 9 wherein said laterally deflectable fingers are biased toward each other and are positioned to contact the leading corners of the box passing through said lidding station and to be deflected thereby to release said lid thereabove onto said box.

11. In the system of claim 7 wherein said lower stack of lids is periodically replenished by selectively retracting said members whereby said upper stack of lids drops vertically by gravity in said chute, said dropped upper stack of lids being caught by said four fingers projecting inwardly of said chute.

12. In the system of claim 11 further comprising guide members on each of the four sides of said chute biased inwardly toward the center of said chute for precisely positioning over said open top box passing through said lidding station.

13. In the system of claim 7 further comprising a conveyor means for supplying a plurality of said upper stacks of lids adjacent to said chute, and means to move a single upper stack of lids from said conveyor means to the upper portion of said chute to be deposited in said chute and supported by said four members.

14. In the system of claim 7 further comprising a pressure means suspended over said horizontal conveyor downstream of said lidding station to press, upon continued movement of said box by said conveyor, said lid onto said box.

15. In the system of claim 14 wherein said pressure means comprises at least one vertically adjustable horizontally positioned bar oriented longitudinally in the direction of movement of said series of boxes, said bar being located a predetermined distance away from said conveyor adjacent said lidding station and extending downwardly to a lesser distance, said lesser distance being approximately the height of a fully closed lidded box.

16. A continuous system for placing a rectangular lid with depending flanges on each of a series of spaced open top rectangular boxes on a moving conveyor passing through a lidding station comprising:

(a) continuously moving generally horizontal first conveyor for transporting through a lidding station a series of spaced open top rectangular boxes oriented in the same preselected position;

(b) a vertical rectangular chute located vertically above said lidding station with a lower portion of said chute in close proximity to said lidding station and an upper portion of said chute vertically above said lower portion, said lower portion containing an inwardly biased guide member on each of its four sides adapted to position a lid precisely above an open top box passing through said lidding station;

(c) a pair of spaced retractable fingers on each of two opposide sides of the lower portion of said chute adapted to move inwardly of said chute to be supportive of a first stack of lids and to move outwardly to be nonsupportive of said first stack, means for interconnecting said pair of fingers, pneumatic power means for simultaneous movement of said pair of fingers to release said first stack of lids whereupon the bottom lid will fall therefrom;

(d) a pair of spaced retractable tongues on each of two opposite sides of said chute and positioned to be insertable between the bottom lid and the next-to-the-bottom lid in said first stack, means for interconnecting said pair of tongues, pneumatic power means for simultaneous movement of said pair of tongues to support all said lids in said first stack above said bottom lid;

(e) a pair of spaced retractable members on each of two sides of the upper portion of said chute adapted to move inwardly of said chute to be supportive of a second stack of lids and to move outwardly to be nonsupportive of said second stack, means for interconnecting said pair of members, pneumatic power means for simultaneous movement of said pair of members to deposit said second stack of lids onto the topmost lid of said first stack;

(f) a second conveyor for moving a series of spaced stacks of lids identical with said second stack of lids, intermittent means to move a stack from said series onto said members supporting of said second stack of lids whenever said second stack of lids have been dropped onto said topmost lid of said first stack of lids;

(g) a pair of fixed supporting shoulders attached to and directed inwardly of said chute below said fingers supporting said first stack of lids and positioned above the trailing edge of the open top box in said lidding station, a pair of laterally deflectable fingers attached to said chute above the leading edge of said open top box and located between said leading and trailing edges when said box is fully in vertical alignment below said lid, said laterally deflectable fingers being spring biased to extend inwardly of said chute until contacted by the leading edge of said open top box and thereby deflected outwardly of said chute by continued movement of said box on said conveyor, said pair of shoulders and pair of laterally deflectable fingers catching and maintaining said bottom lid when released by said pair of retractable fingers, said bottom lid being released upon lateral delection of said deflectable fingers by said box whereupon said box pulls said bottom lid onto said box by continued movement thereof through said lidding station by said first conveyor; and (h) a pressure means suspended above said first conveyor downstream of said lidding station to press, upon continued movement of said box, said bottom lid into place on said open top box after said box leaves said lidding station.

* * * * *